United States Patent [19]

Watanabe et al.

[11] Patent Number: 4,740,494

[45] **Date of Patent: * Apr. 26, 1988**

[54] METHOD OF RECORDING IMAGE

[75] Inventors: Hideo Watanabe, Numazu; Keishi Kubo, Yokohama; Kanzirou Kawasaki, Numazu; Minoru Hakiri, Numazu; Nobuhiro Takigawa, Numazu, all of Japan

[73] Assignee: Ricoh Co., Ltd., Tokyo, Japan

[ * ] Notice: The portion of the term of this patent subsequent to Nov. 11, 2003 has been disclaimed.

[21] Appl. No.: 668,233

[22] Filed: Nov. 5, 1984

[30] Foreign Application Priority Data

Nov. 9, 1983 [JP] Japan ..... 58-210614

[51] Int. Cl.[4] ..... B41M 5/18; B41M 5/22

[52] U.S. Cl. ..... 503/201; 427/152; 503/204; 503/206; 503/207; 503/226

[58] Field of Search ..... 346/200, 226, 201, 204, 346/206; 427/150, 151, 152; 503/200, 201, 204, 206, 207, 226

[56] References Cited

U.S. PATENT DOCUMENTS

| | | | |
|---|---|---|---|
| 4,273,602 | 6/1981 | Kosaka et al. | 427/150 |
| 4,401,721 | 8/1983 | Hida | 346/226 |
| 4,503,095 | 3/1985 | Seto et al. | 428/488.4 |
| 4,622,565 | 11/1986 | Watanabe et al. | 346/206 |

FOREIGN PATENT DOCUMENTS

| | | | |
|---|---|---|---|
| 47-22134 | 10/1972 | Japan | 503/200 |
| 50-2534 | 1/1976 | Japan | 503/200 |
| 0074194 | 5/1982 | Japan | 346/206 |
| 0035981 | 2/1984 | Japan | 346/206 |
| 0127793 | 7/1984 | Japan | 346/204 |
| 0101078 | 6/1985 | Japan | 346/201 |
| 0183185 | 9/1985 | Japan | 346/204 |
| 0183188 | 9/1985 | Japan | 346/204 |

*Primary Examiner*—Bruce H. Hess

*Attorney, Agent, or Firm*—Flynn, Thiel, Boutell & Tanis

[57] ABSTRACT

This invention relates to a method of recording an image, characterized by superposing a heat-sensitive transfer medium on a plain paper and heating the medium thereby transferring a leuco dye from a leuco dye-containing transfer layer and a developer from a developer-containing transfer layer respectively onto the plain paper to react the leuco dye and the developer, said heat-sensitive transfer medium being prepared by having a transfer layer containing a leuco dye as the main component and a transfer layer containing a developer as the main component respectively applied on a single substrate or two separate substrates.

8 Claims, No Drawings

METHOD OF RECORDING IMAGE

BACKGROUND OF THE INVENTION

The present invention relates to a method of recording an image utilizing a color-forming reaction between a leuco dye and a developer therefor.

As conventional heat-sensitive transfer mediums, there are known one comprising a combination of a transfer sheet having a thermo-sublimating dye layer on a substrate with a receiving sheet receiving a thermo-sublimating dye image from the back side of said transfer sheet by thermal printing, and one comprising a combination of a transfer sheet having a transfer layer containing a heat fusible substance and a chromatogenous agent (dye or pigment) on a substrate with a receiving sheet.

However, the former heat-sensitive transfer medium using the thermo-sublimating dye is defective in that the dye image formed on the receiving sheet is inferior in preservability and therefore an overcoat must be applied on the transferred image, while the latter heat sensitive transfer medium using the transfer sheet having the transfer layer formed by dispersing dye or pigment in the heat-fusible substance is defective in that when a large amount of the chromatogenous agent is incorporated in the transfer layer in order to obtain high density images, the transfer efficiency deteriorates, and consequently it is difficult to obtain high density images, and further when a large amount of heat fusible substance is used in the transfer layer in order to raise heat-sensitivity, a large amount of heat fusible substance transfers to the receiving sheet side, and consequently when stripping the transfer sheet of the receiving sheet, it is not stripped smoothly and the fine-lined image area becomes indistinct. Moreover, since the transfer sheet contains the chromatogenous agent, it often soils a non-image area when it is brought into a strong contact with the receiving sheet.

SUMMARY OF THE INVENTION

An object of the present invention is to provide a method of recording an image by a heat-sensitive transfer system, by which the heat-sensitive transfer is carried out at a high heat-sensitivity while preventing a non-image area from being soiled.

More particularly, an object of the present invention is to provide a method of recording an image, characterized by superposing a heat-sensitive transfer medium on plain paper and heating the medium thereby transferring a leuco dye from a leuco dye-containing transfer layer and a developer from a developer-containing transfer layer, respectively, onto the plain paper to react the leuco dye and the developer, said heat-sensitive transfer medium being prepared by having a transfer layer containing a leuco dye as the main component and a transfer layer containing a developer as the main component respectively applied on a single substrate or two separate substrates.

DETAILED DESCRIPTION OF THE INVENTION

According to the present invention, a heat-sensitive transfer medium having a transfer layer containing a leuco dye as the main component and a transfer layer containing a developer as the main component respectively applied on a single substrate or two separate substrates is used.

Since a leuco dye and a developer used in the present invention are usually colorless or light-colored, a heat-sensitive transfer medium having these transfer layers does not soil plain paper simply by strongly pressing the transfer medium upon the paper. Therefore, when developed, a developed image is clear since the non-image area is not soiled.

According to the present invention, an image is developed by superposing the above mentioned heat-sensitive transfer medium on plain paper and heating the medium thereby transferring a leuco dye (or developer) from a leuco dye-(or developer-)containing layer and a developer (or leuco dye) from a developer-(or leuco dye-)containing layer respectively onto the paper to react the two. The heat-sensitive transfer medium is characterized in that the adhered amount of the leuco dye and developer is small and that the heat-sensitivity is high. That is, a high density image can be obtained by about 1 g/m$^2$, a total transferred amount of the leuco dye and developer.

An amount of a developer transferred onto plain paper is 1–10 parts by weight, preferably 2–5 parts by weight to 1 part by weight of a leuco dye transferred.

A porous filler may be included in each transfer layer in order that the heat-sensitive transfer medium of the present invention can provide a uniform colored image even when the transfer sheet is repeatedly used a large number of times. The porous filler used herein preferably has properties that an oil absorption amount is at least 50 ml/100 g, preferably more than 150 ml/100 g. An amount of porous filler added to a transfer layer is 0.01–1 part by weight, preferably 0.03–0.5 part by weight to 1 part by weight of a leuco dye or a developer.

Examples of a porous filler include inorganic and organic fine powders such as silica, aluminum silicate, alumina, aluminum hydroxide, magnesium hydroxide, urea-formaldehyde resin, styrene resin and the like.

The transfer sheet used in the present invention is prepared by applying a transfer layer containing a leuco dye as the main component and a transfer layer containing a developer as the main component on a substrate such as paper, synthetic paper, plastic film and the like. Each transfer layer may contain a porous filler and resin depending on the required use. The substrate may be a single one or separate ones. In the case of using the single one, transferring is effected by superimposing the substrate on a sheet of plain paper and successively imagewise transferring leuco dye and developer from different areas of the substrate onto said sheet in overlapping relationship. In the case of using the separate ones, transferring is effected by overlapping.

As the leuco dye referred to herein, there may be employed any one which has usually been used in a pressure sensitive paper or heat sensitive paper, and for instance those of triphenylmethane type, fluoran type, phenothiazine type, Auramine type and spiropyran type are suitably used. Examples of preferable leuco dyes include:

3,3-bis(p-dimethylaminophenyl)-phthalide,
3,3-bis(p-dimethylaminophenyl)-6-dimethylaminophthalide (another name: Crystal Violet lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide, 3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-(N-(3'-trifluoromethylphenyl)amino)-6-diethylamino-fluoran,
2-(3,6-bis(diethylamino)-9-(o-chloroanilino)xanthyl benzoic acid lactam),
3-diethylamino-6-methyl-7-(m-trichloromethylanilino)-fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilino-fluoran,
3-diethylamino-6-methyl-7-anilinofluoran,
3-(N,N-diethylamino)-5-methyl-7-(N,N-dibenzylamino)fluoran,
benzoyl leuco Methylene Blue,
6'-chloro-8'-methoxy-benzoindolino-pyrilospiran,
6'-bromo-3'-methoxy-benzoindolino-pyrilospiran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide, and
3-(2'-methoxy-4'-dimethylaminophenyl)-3-(2'-hydroxy-4'-chloro-5'-methylphenyl)phthalide.

As the developer referred to herein, there may be used an electron-receiving substance, for instance a phenolic substance, an organic acid or its salt or ester or the like. From a practical view point, the electron-receiving substance having a melting point of 200° C. or less is preferably applicable. Examples of developers preferably used in the present invention are shown below. In this connection, it is to be noted that the numerals enclosed with brackets denote melting points.

4-t-butylphenol(98), 4-hydroxydiphenyl ether(84),
1-naphthol(98), 2-naphthol(121), methyl-4-hydroxy benzoate(131), 4-hydroxyacetophenone(109),
2,2'-dihydroxydiphenylether(79), 4-phenylphenol(166),
4-t-octylcatechol(109), 2,2'-dihydroxydiphenyl(103),
4,4'-methylenebisphenol(160),
2,2'-methylenebis(4-chlorophenol)(164),
2,2'-methylenebis(4-methyl-6-t-butylphenol)(125),
4,4'-isopropylidenediphenol(156),
4,4'-isopropylidenebis(2-chlorophenol)(90),
4,4'-isopropylidenebis(2,6-dibromophenol)(172),
4,4'-isopropylidenebis(2-t-butylphenol)(110),
4,4'-isopropylidenebis(2-methylphenol)(136),
4,4'-isopropylidenebis(2,6-dimethylphenol)(168),
4,4'-s-butylidenediphenol(119),
4,4'-s-butylidenebis(2-methylphenol)(142),
4,4'-cyclohexylidenediphenol(180),
4,4'-cyclohexylidenebis(2-methylphenol)(184), salicyclic acid(163), metatolyl salicylate(74),
phenacyl salicylate(110),
methyl14-hydroxybenzoate(131),
ethyl14-hydroxybenzoate(116),
propyl14-hydroxybenzoate(98),
isopropyl14-hydroxybenozoate(86),
butyl14-hydroxybenzoate(71),
isoamyl14-hydroxybenzoate(50),
phenyl14-hydroxybenzoate(178),
benzyl14-hydroxybenozate(111),
cyclohexyl14-hydroxybenzoate(119),
5-hydroxysalicylic acid(200), 5-chlorosalicylic acid(172), 3-chlorosalicylic acid(178), thiosalicylic acid(164), 2-chloro-5-nitrobenzoic acid(165),
4-methoxyphenol(53), 2-hydroxybenzylalcohol(87),
2,5-dimethylphenol(75), benzoic acid(122),
orthotoluic acid(107), metatoluic acid(111),
paratoluic acid(181), orthochlorobenzoic acid(142),
metaoxybenzoic acid(200),
2,4-dihydroxy-acetophenone(97), resorcinol monobenzoate(135), 4-hydroxybenzophenone(133),
2,4-dihydroxybenzophenone(144), 2-naphthoicacid(184),
1-hydroxy-2-naphthoic acid(195), ethyl 3,4-dihydroxybenzoate(128), phenyl 3,4-dihydroxybenzoate(189),
4-hydroxypropiophenone(150), salicylsalicylate(148), monobenzyl phthalate(107),
bis(4-hydroxyphenylmercapto)methane(55),
1,2-bis(4-hydroxyphenylmercapto)ethane(173),
1,3-bis(4-hydroxyphenylmercapto)propane(82),
1,4-bis(4-hydroxypehnylmercapto)butane(182),
1,5-bis(4-hydroxyphenylmercapto)pentane(98),
1,6-bis(4-hydroxyphenylmercapto)hexane(166),
1,3-bis(4-hydroxyphenylmercapto(acetone(74),
1,5-bis(4-hydroxyphenylmercapto)-3-oxapentane(93),
1,7-bis(4-hydroxyphenylmercapto)-3,5-dioxaheptane(108), and
1,8-bis(4-hydroxyphenylmercapto)-3,6-dioxaoctane(100).

Said leuco dye and said developer of the present invention are used on a substrate in an amount of 0.2–10 g/m$^2$, preferably 0.3–0.5 g/m$^2$.

The leuco dye and the developer are usually supported on a substrate by means of a binder. The binder used in the present invention may be any of thermoplastic or heat-curable resins, but preferably a resin having a melting point or softening point of 50°–130° C. in view of heat-resistance and heat-sensitivity of a transfer sheet.

Examples of a resin used as a binder include: polyethylene, polypropylene, polystyrene, petroleum resin, acrylic resin, vinyl chloride resin, vinyl acetate resin, vinylidene chloride resin, polyvinylalcohol, cellulose resin, polyamide, polyacetal, polycarbonate, polyester, fluorine-containing resin, silicone resin, natural rubber, chlorinated rubber, butadiene rubber, olefin rubber, phenol resin, urea resin, melamine resin, epoxy resin, polyimide and the like.

The resin as mentioned above can be used as a homopolymer, copolymer or a mixture of plural resins. The resin is used in an amount of 0.01–1 part by weight to one part by weight of each of a leuco dye and a developer. If the amount of resin is less than 0.01 part by weight, the adhesive power to a transfer sheet is lessened and it becomes impossible to satisfactorily support a leuco dye and a developer on a substrate. On the other hand, if the amount of resin is more than 1 part by weight, the heat-sensitivity of the product thus obtained is lowered and the transferred image density is also lowered. The resin is used preferably in an amount of 0.05–0.5 part by weight to one part by weight of each of a leuco dye and a developer in order to obtain a satisfactory uniform image density even when a transfer sheet is repeatedly used a large number of times. The resin may be applied on a substrate by any of solvent coating, hot-melt coating, aqueous emulsion coating and other methods.

When preparing a transfer sheet, a transfer layer-forming solution may uniformly be applied on the whole part of the surface of a substrate to form the so-called plain cloth-like (non-image-wise) transfer layer. The non-image-wise transfer layer can be formed simply by uniformly coating a transfer layer-forming solution on the whole surface of a substrate. If desired, a transfer layer-forming solution may also be applied in such a manner as to form an image-wise transfer layer by making a desirable image-wise (including letters) coating. This image-wise coating can be effected by coating a transfer layer-forming solution on a substrate by means of letterpress printing, gravure printing or other printing techniques.

According to the present invention, the heat transfer can be effected in the following manner. In the case of a transfer sheet having a non-image-wise transfer layer, the heat transfer is carried out by superposing a plain paper on the transfer layer of the transfer sheet and directly heat-pressing the back side of the transfer sheet by means of a thermal printer or the like. On the other hand, in the case of a transfer sheet having an image-wise transfer layer, the heat transfer is carried out by superposing a plain paper on the transfer layer of the transfer sheet and passing them between hot rolls.

DESCRIPTION OF THE PREFERRED EMBODIMENTS

The present invention is further illustrated by the following Examples, but is not limited thereto.

EXAMPLE 1

(1) Preparation of Transfer Sheet (A-1)

| | |
|---|---|
| 3-N—methyl-N—cyclohexylamino-6-methyl-7-anilinofluoran | 10 g |
| polyester resin | 3 g |

The transfer sheet (A-1) was prepared by dissolving 3 g of the above composition in 100 g of methyl ethyl ketone, coating the solution thus obtained on a polyester film of a thickness of 6 μm by a wirebar and drying the coated film to prepare a transfer sheet having a coated amount of 1 g/m$^2$.

(2) Preparation of Transfer Sheet (B-1)

| | |
|---|---|
| n-butyl 4-hydroxybenzoate | 20 g |
| polyvinyl alcohol | 3 g |
| water | 100 g |

The transfer sheet (B-1) was prepared by dispersing the above composition in a ball mill for 24 hours, coating the dispersion thus obtained on a polyester film of a thickness of 6 μm by a wirebar and drying the coated film to prepare a transfer sheet having a coated amount of 2 g/m$^2$.

The transfer sheet (A-1) thus obtained was superposed on plain paper bringing the transfer layer into contact with the plain paper, and a heat energy of 1 mJ was applied from the back side of the transfer sheet (A-1) by a thermal head. Moreover, the transfer sheet (B-1) was further superposed on the same place, and a heat energy of 1 mJ was applied from the back side of the transfer sheet (B-1) by a thermal head in the same manner as above, thus forming a sharp black image of an image density of 1.24 on the plain paper.

In another way, the transfer sheet (B-1) was superposed on plain paper bringing the transfer layer into contact with the plain paper, and a heat energy of 1 mJ was applied from the back side of the transfer sheet (B-1) by a thermal head. Moreover, the transfer sheet (A-1) was further superposed on the same place, and a heat energy of 1 mJ was applied from the back side of the transfer sheet (A-1) in the same manner as above, thus forming a sharp black image of an image density of 1.20 on the plain paper.

In the both cases, non-image areas were not soiled at all.

EXAMPLE 2

(1) Preparation of Transfer Sheet (A-2)

| | |
|---|---|
| 3-diethylamino-6-chlorofluoran | 15 g |
| styrene resin | 3 g |

The transfer sheet (A-2) was prepared by dissolving the above composition in 100 g of methyl ethyl ketone, coating the solution thus obtained on a polyester film of a thickness of 6 μm by a wire bar and drying the coated film to form a transfer sheet having a coated amount of 1 g/m$^2$.

(2) Preparation of Transfer Sheet (B-2)

| | |
|---|---|
| 1,3-bis(4-hydroxyphenylmercapto)propane | 25 g |
| polyvinyl pyrrolidone | 5 g |

The transfer sheet (B-2) was prepared by dissolving the above composition in 100 g of ethanol, coating the solution thus obtained on a polyester film of a thickness of 6 μm by a wire bar and drying the coated film to form a transfer sheet having a coated amount of 2 g/m$^2$.

The transfer sheets (A-2) and (B-2) thus prepared were respectively superposed on a plain paper and heat energy of 1 mJ was applied on each of them in the same manner as in Example 1, thus forming a sharp red image of an image density of 1.15 on the plain paper. Non-image areas were not soiled at all.

EXAMPLE 3

(1) Preparation of Transfer Sheet (A-3)

| | |
|---|---|
| Crystal Violet lactone | 15 g |
| silica particles (oil absorption amount: 300 ml/100 g) | 1 g |
| vinylchloride/vinylacetate copolymer | 2 g |
| methyl ethyl ketone | 100 g |

The transfer sheet (A-3) was prepared by dispersing the above composition in a ball mill for 24 hours, coating the dispersion thus obtained on condenser paper of a thickness of 10 um and drying the coated paper to form a transfer sheet having a coated amount of 3 g/m$^2$.

(2) Preparation of Transfer Sheet (B-3)

| | |
|---|---|
| 1,5-bis(4-hydroxyphenylmercapto)-3-oxapentane | 20 g |
| silica particles | 2 g |
| ethyl cellulose | 2 g |

-continued

| | |
|---|---|
| methyl cellosolve | 100 g |

The transfer sheet (B-3) was prepared by dispersing the above composition in a ball mill for 24 hours, coating the dispersion thus obtained on a condenser paper of a thickness of 10 um and drying the coated paper to form a transfer sheet having a coated amount of 4 g/m$^2$.

The transfer sheets (A-3) and (B-3) thus prepared were respectively superposed on plain paper, and a heat energy of 1.5 mJ was applied on each of them in the same manner as in Example 1, thus forming a sharp blue image of an image density of 1.20 on the plain paper.

The above procedure was repeated on other parts of a piece of plain paper ten times, and each time provided a sharp blue image on the plain paper. The image density at the tenth time was 1.13. Non-image areas on the plain paper were not soiled at all.

As clearly seen from the above Examples, the method of the present invention of using a colorless or light colored leuco dye and developer for forming a desired recording image does not soil non-image areas of paper at all although the conventional heat-fusible colored ink soils the paper when pressed on the paper. Moreover, according to the present invention, an image of a high density can be obtained by a minute heat energy, and a great number of copies can be obtained by a single transfer sheet, thus providing an economical merit.

What is claimed is:

1. A method of recording an image utilizing a bipartite heat-sensitive transfer means comprising a first layer comprising a leuco dye and being free of a developer for said leuco dye, a second layer which is separate from said first layer, said second layer comprising a developer and being free of leuco dye, the developer when brought into contact with the leuco dye being capable of reacting with the leuco dye to form a visible image, which method comprises the steps of: separately and sequentially heating said first and second layers while said transfer means is superimposed on a plain paper receiving sheet so as to effect successive patternwise transfer of (1) leuco dye from said first layer and (2) developer from said second layer, into superimposed contact on the same areas of said receiving sheet whereby the leuco dye and developer react with each other to form a visible image on said receiving sheet.

2. A method of recording an image according to claim 1, wherein both said leuco dye and developer are colorless or light colored.

3. A method of recording an image according to claim 1, wherein the amount of said developer that is tranferred to said receiving sheet is 1–10 parts by weight per 1 part by weight of said leuco dye that is transferred.

4. A method of recording an image according to claim 1, wherein each of said layers contains porous fillers having an oil absorption capacity of at least 50 ml/100 g, said fillers being present in each layer in an amount of 0.01–1 part by weight per 1 part by weight of each of said leuco dye and developer.

5. A method of recording an image according to claim 1, wherein said developer has a melting point of not higher than 200° C. and each of said leuco dye and said developer is applied on said heat-sensitive transfer means in an amount of 0.2–10 g/m$^2$.

6. A method of recording an image according to claim 1, wherein said leuco dye and said developer are supported on said heat-sensitive transfer means by means of a resin binder having a melting point or softening point of 50°–130° C.

7. A method as claimed in claim 1 in which said first and second layers are on a single substrate.

8. A method as claimed in claim 1 in which said first and second layers are on two separate substrates.

* * * * *